US010633215B2

(12) United States Patent
Timmer

(10) Patent No.: US 10,633,215 B2
(45) Date of Patent: Apr. 28, 2020

(54) COMPACT AND STACKABLE HOSE REEL

(71) Applicant: Joh. Mourik & Co. Holding B.V., Groot-Ammers (NL)

(72) Inventor: Paul Timmer, Groot-Ammers (NL)

(73) Assignee: Joh. Mourik & Co. Holding B.V., Groot-Ammers (NL)

( * ) Notice: Subject to any disclaimer, the term of this patent is extended or adjusted under 35 U.S.C. 154(b) by 93 days.

(21) Appl. No.: 15/788,827

(22) Filed: Oct. 20, 2017

(65) Prior Publication Data

US 2019/0119065 A1 Apr. 25, 2019

(51) Int. Cl.
*B65H 75/44* (2006.01)
*B65H 75/40* (2006.01)
*B65H 75/28* (2006.01)

(52) U.S. Cl.
CPC ..... *B65H 75/40* (2013.01); *B65H 75/28* (2013.01); *B65H 75/4402* (2013.01); *B65H 75/446* (2013.01); *B65H 75/4457* (2013.01); *B65H 75/4478* (2013.01); *B65H 2701/33* (2013.01); *Y10T 137/6921* (2015.04)

(58) Field of Classification Search
CPC ..... B65H 75/4402; B65H 75/4457; B65H 75/4478; B65H 75/446; Y10T 137/6921
See application file for complete search history.

(56) References Cited

U.S. PATENT DOCUMENTS 1,746,995 A * 2/1930 Edwards ..... B65H 75/38 137/355.17
2,334,141 A * 11/1943 Zierden ..... B65H 75/364 137/355.28
5,335,687 A * 8/1994 Odom ..... B65H 75/364 137/15.01
5,787,923 A * 8/1998 Shea ..... B65H 75/4402 137/355.23
6,604,543 B1 * 8/2003 Guo ..... B65H 75/40 137/355.26
9,322,429 B2 * 4/2016 Bauck ..... B65H 75/4478
2014/0301807 A1 * 10/2014 Hallot ..... B63B 27/34 414/137.9

* cited by examiner

*Primary Examiner* — Kevin F Murphy
(74) *Attorney, Agent, or Firm* — David Philip Owen

(57) ABSTRACT

A hose reel 1 comprising a rotatable hub 2 and a stationary stand 4, wherein rotatable hub is arranged to roll on or roll off a hose. A swivel arrangement 3 forms an axis around a central axis of the rotatable hub, wherein the swivel arrangement comprises a rotatable part connecting to the rotatable hub and a stationary part connecting to the stationary stand, and wherein the swivel arrangement forms a passage for fluid.

13 Claims, 8 Drawing Sheets

(A-A)

(A-A)

COMPACT AND STACKABLE HOSE REEL

TECHNICAL HELD

The invention relates to hose reels. More particularly the invention relates to compact and stackable hose reek.

BACKGROUND ART

Typically, hose reels are used for the purpose of providing a hub or spool onto which a hose may be wound for storing the hose when not in use. The reel may be connected via a supply hose to a fluid supply, enabling the reel to function as a hub between the fluid supply and the hose. The hose may me partly or fully rolled off the reel when used. The length of hose that was rolled off from the reel may be rolled on again after use. This is achieved by rotating the reel in the proper direction as the extended length of hose wraps itself on the hub of the reel, layer after layer.

Hose reels are typically bulky. When multiple hoses are used in a confined space, with each hose having its own hose reel, the required space for accommodating the hose reels can become problematic.

Consequently, one may choose not to use hose reels and have the hoses lying on the floor. This may result in an unsafe working environment where people trip over the hoses. Moreover, clearing the hoses after use can be labor intensive without a hose reel.

An example where hoses are typically used without hose reels because of the bulky nature of hose reels, is the cleaning of the interior of heat exchangers, which is typically an operation involving a Trans Line Exchanger (TLE) or Trans Tube Cleaners (TLC). The TLE and LTC are machines that make use of one up to three high pressure hoses that enter the cooler pipes of a heat exchanger. It is common practice that the hoses, which are connected to the TLE or LTC machine, are lying on the floor in a disoriented order. This is caused by the length of the hoses, which can be 20 meters or more, which causes strangling. At the same the strangled hoses may cause a dangerous situation for the craftsmen steering the TLE or LTC machine or other people just passing this working area. To make this working situation more controlled and safe an extra person may be issued to guide and unstrangle the hoses during the cleaning operation.

Thus, there is a need for compact hose reels that may be used in a confined space, allowing one or more hoses to be used in a safer and more efficient manner.

SUMMARY OF INVENTION

The invention provides a compact hose reel that may be used in a confined space (or any other space), allowing one or more hoses to be used in a safer and more efficient manner. Moreover, hose reels of the present invention may be compactly stacked while allowing the hoses to be independently rolled on and off the hose reels.

According to an aspect of the invention, a hose reel is proposed. The hose reel can comprise a rotatable hub and a stationary stand. The rotatable hub can be arranged to roll on or roll off a hose. The hose reel can comprise a swivel arrangement that forms an axis around a central axis of the rotatable hub. The swivel arrangement can comprise a rotatable part connecting to the rotatable hub and a stationary part connecting to the stationary stand. The swivel arrangement can form a passage for a fluid.

In an embodiment, the stationary stand can be arranged to support the rotatable hub via the swivel arrangement.

In an embodiment, the rotatable part of the swivel arrangement can comprise an outlet mount for connecting the hose to the rotatable hub. The outlet mount can be arranged to rotate with the rotatable hub when rolling on or rolling off the hose.

In an embodiment, the rotatable part of the swivel arrangement can comprise a head part. The outlet mount can pass through the head part in a direction away from the central axis.

In an embodiment, a top of the head part can form a surface substantially perpendicular to the central axis for supporting a cover that covers at least a portion of the hose when rolled onto the rotatable hub.

In an embodiment, the stationary part of the swivel arrangement can comprise an inlet mount for connecting an external hose to the hose reel.

In an embodiment, the outlet mount can be rotatably connected to the inlet mount by a swivel joint.

In an embodiment, the rotatable part of the swivel arrangement can comprises a hollow shaft aligned with the central axis. The hollow shaft can be connected to the outlet mount and can be arranged to rotate around the central axis with the rotatable hub when rolling on or rolling off the hose. The hollow shaft can be movably connected to the inlet mount via the swivel joint. The hollow shaft can be rotatably fixed within the stationary part of the swivel arrangement by a bearing arrangement.

In an embodiment, the rotatable part of the swivel arrangement can comprise a first circumferential edge extending perpendicularly from and centered around the central axis. The first circumferential edge can comprise one or more through holes for fixing the rotatable hub to the rotatable part of the swivel arrangement.

In an embodiment, the stationary part of the swivel arrangement can comprise a second circumferential edge extending perpendicularly from and centered around the central axis. The second circumferential edge can comprise one or more through holes for fixing the stationary stand to the stationary part of the swivel arrangement.

In an embodiment, the stationary stand allows multiple hose reels to be stacked. The swivel arrangement can allow the stationary stands of stacked hose reels to be non-movably fixed while the rotatable hubs of the stacked hose reels are independently rotatable.

In an embodiment, the stationary stand can comprises connection pins extending in a direction parallel to the direction of the central axis. Each pin can comprise a top end and a bottom end. The top end of a pin of one hose reel can be arranged to interconnect with the bottom end of a pin of another hose reel.

In an embodiment, the hose real can further comprise a hose guide for guiding the hose from the rotatable hub to outside of a perimeter of the stationary stand.

In an embodiment, the hose guide can be adjustably connected to one of the pins.

In an embodiment, the swivel arrangement can be arranged to pass the fluid under a high pressure, preferably up to around 20K Psi.

According to an aspect of the invention, a swivel arrangement is proposed for use in a hose real. The hose real and the swivel arrangement can have one or more of the above described features.

Hereinafter, embodiments of the invention will be described in further detail. It should be appreciated, however, that these embodiments may not be construed as limiting the scope of protection for the present invention.

BRIEF DESCRIPTION OF DRAWINGS

Embodiments of the invention will now be described, by way of example only, with reference to the accompanying schematic drawings in which corresponding reference symbols indicate corresponding parts, and in which.

The figures are meant for illustrative purposes only, and do not serve as restriction of the scope or the protection as laid down by the claims.

DESCRIPTION OF EMBODIMENTS

Figure 1:
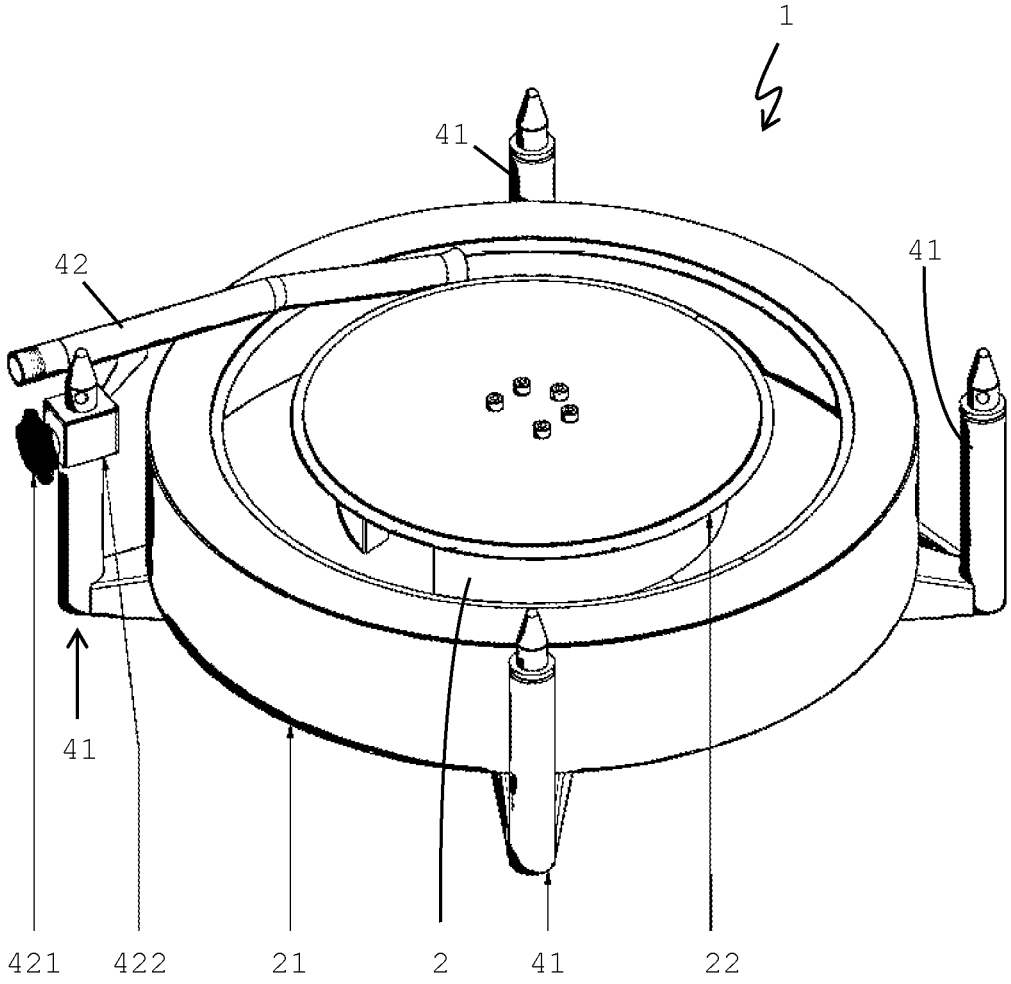
FIG. 1 is a three dimensional view of an exemplary hose reel.
Figure 5:
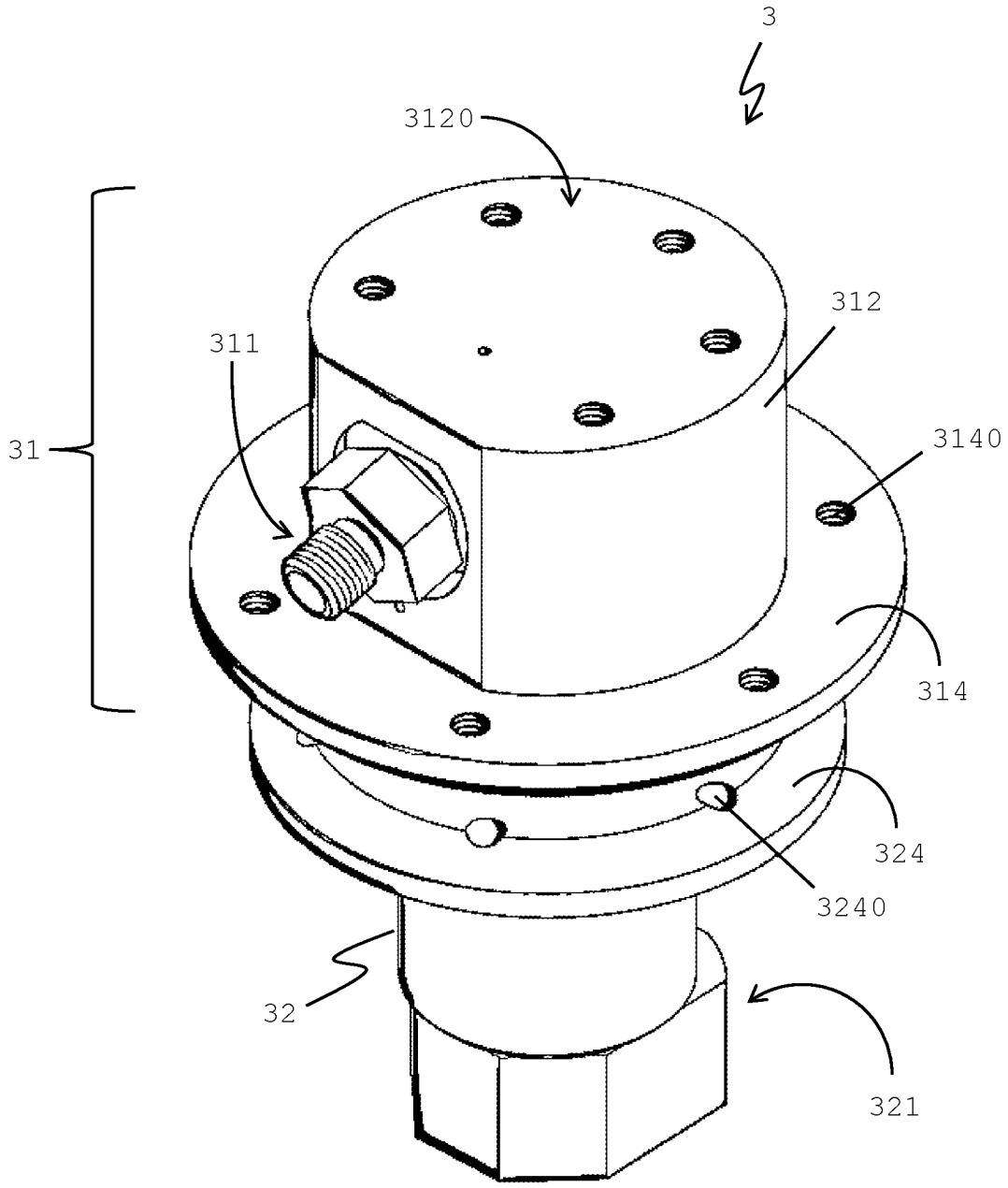
FIG. 5 is a three dimensional view of an exemplary swivel arrangement.

The hose reel of the present invention, such as shown in FIG. 1, has a compact design. Various parts of the hose reel contribute to the compact design, in particular the development of a swivel arrangement 3 such as shown in FIG. 5.

FIG. 1 shows an exemplary hose reel 1, including a rotatable hub 2 around which a hose may be rolled. The hose may be kept in place by a drum 21 and a cover 22, which typically rotate together with the hub 2.

Figure 9:
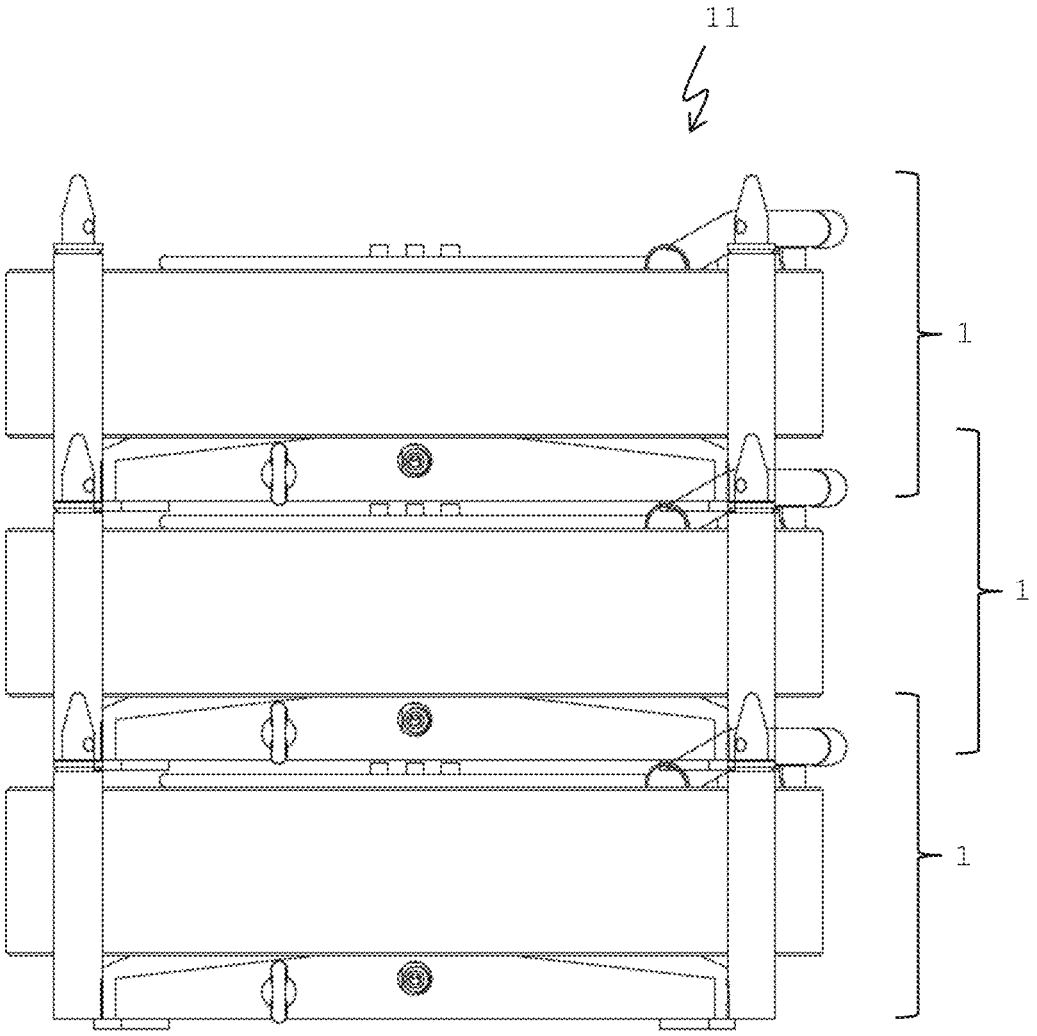
FIG. 9 is a side view of vertically stacked hose reels.
Figure 10:
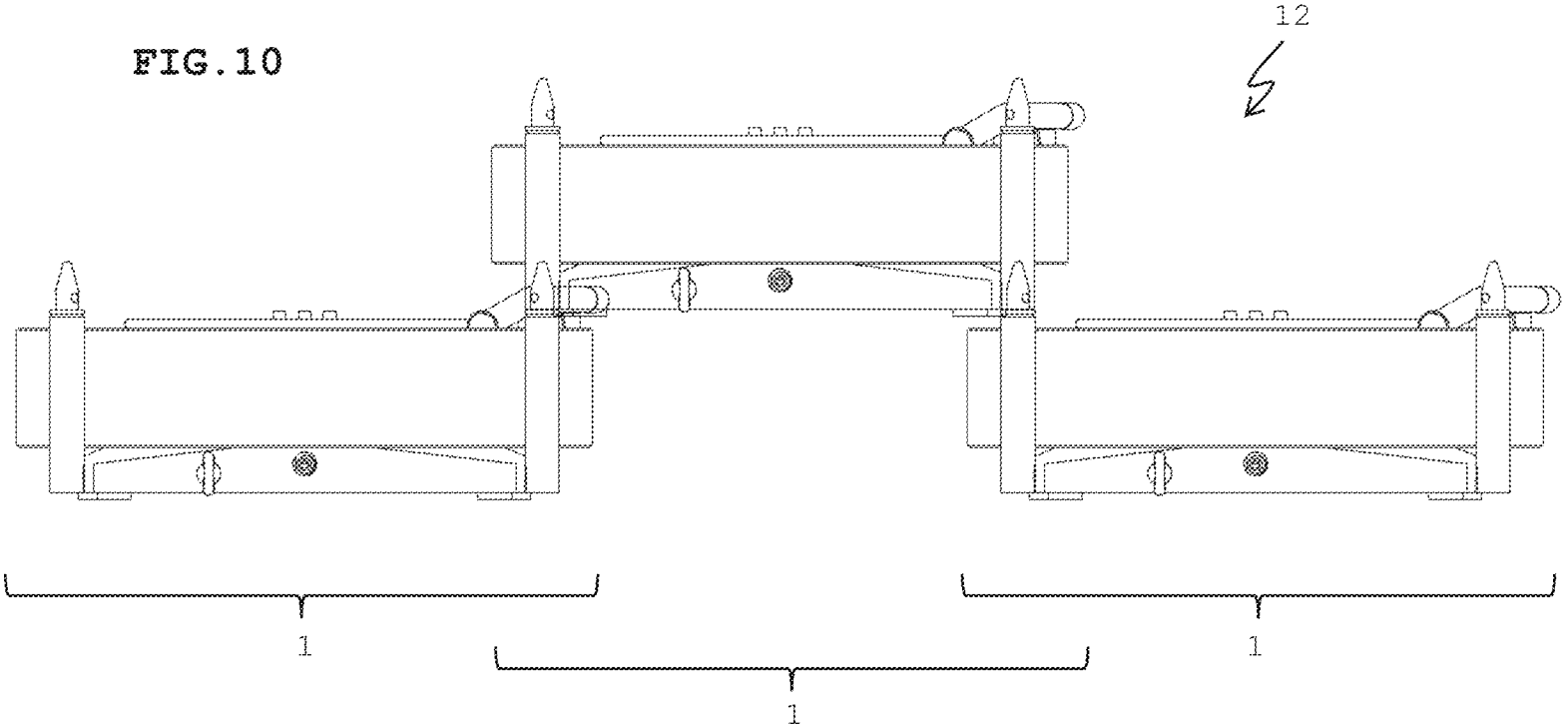
FIG. 10 is a side view of horizontally stacked hose reels.

Connection pins 41 may enable multiple hose reels 1 to be stacked, such as shown in FIG. 9 and FIG. 10. In FIG. 9 three hose reels 1 are shown in a vertical stack 11 of hose reels. In FIG. 10 three hose reels 1 are shown in a horizontal stack 12 of hose reels. It will be understood that any number of hose reels may be stacked. Furthermore, any combination of vertical and horizontal stacking may be used. In case of multiple stacked hose reels, the hoses on each reel may move independently of each and each hose may have its own supply fluid.

Figure 2:
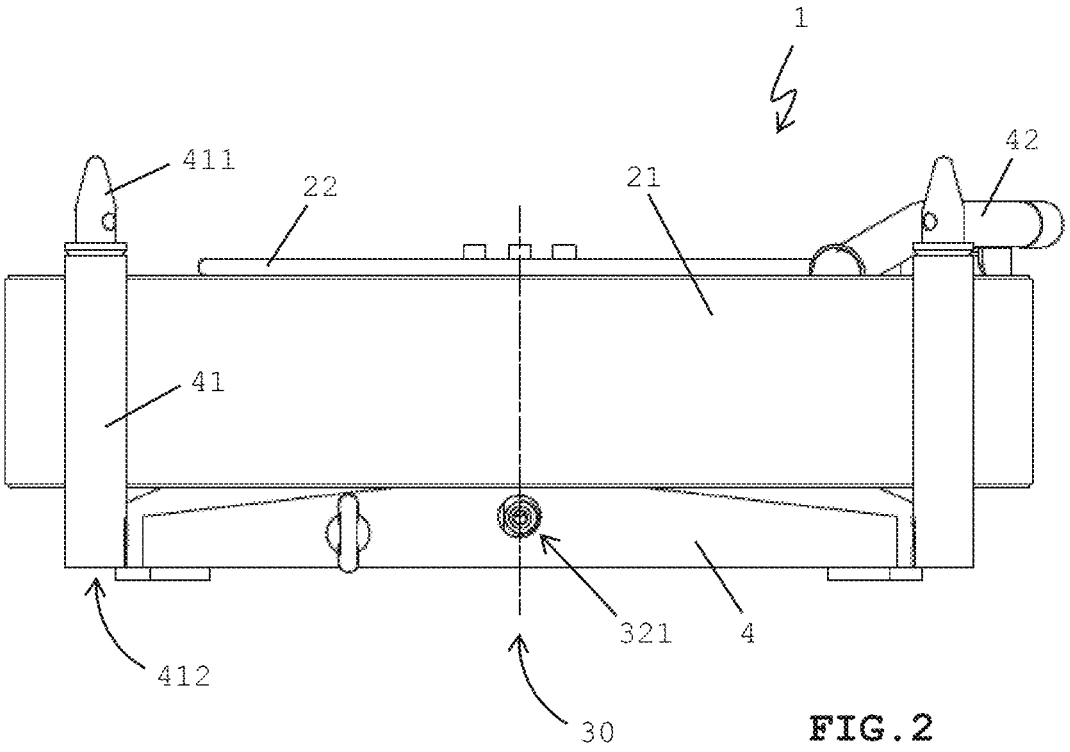
FIG. 2 is a side view of an exemplary hose reel.

The connection pins 41 are typically connected to a stationary stand 4 of the hose reel 1, as shown in FIG. 2. As such, the pins 41 are stationary with respect to the rotatable hub 2.

FIG. 1 furthermore shows a hose guide 42 through which the hose may be guided towards the hub 2, thereby assuring accurate reeling. Such hose guide 42 is particularly useful when multiple hose reels 1 are stacked, such as shown in FIG. 9 or FIG. 10. The hose guide 42 may be fixed to the stationary part of the hose reel via one of the pins 41. Hereto a fixation point 422, which may be attached to the hose guide 42, may be slided onto one of the pins 41 and fixed by a star knob 421. The hose guide 42 may comprise a bended tube on an adjustable clamp.

FIG. 2 shows a side view of a hose reel 1 such as shown in FIG. 1. Of the rotatable parts, the drum 21 and the cover 22 are shown. The pins 41 and the hose guide 42, which are also shown in FIG. 1, are stationary parts. FIG. 2 furthermore shows the stationary stand 4 to which the pins 41 may be attached. The hub 2 is arranged to rotate around the central axis 30 and is supported, via the swivel arrangement 3, by the stationary stand 4. The hub 1, including the swivel arrangement 3, may be placed on a stationary casing on the stand.

The pins 41 may have a top end 411 and a bottom end 412, such that the top end 411 of one hose reel 1 fits inside the bottom end 412 of another hose reel 1, as in a male and female connection. This allows multiple hose reels 1 to be stacked via the pins 41, such as shown in FIG. 9 and FIG. 10. For stability, a minimum of three pins 41 may be preferable when vertically stacking hose reels 1, such as shown in FIG. 9. To also allow horizontally stacking of multiple hose reels 1, such as shown in FIG. 10, four pins 41 that are evenly spaced around the drum 21 may be preferable.

Figure 3:
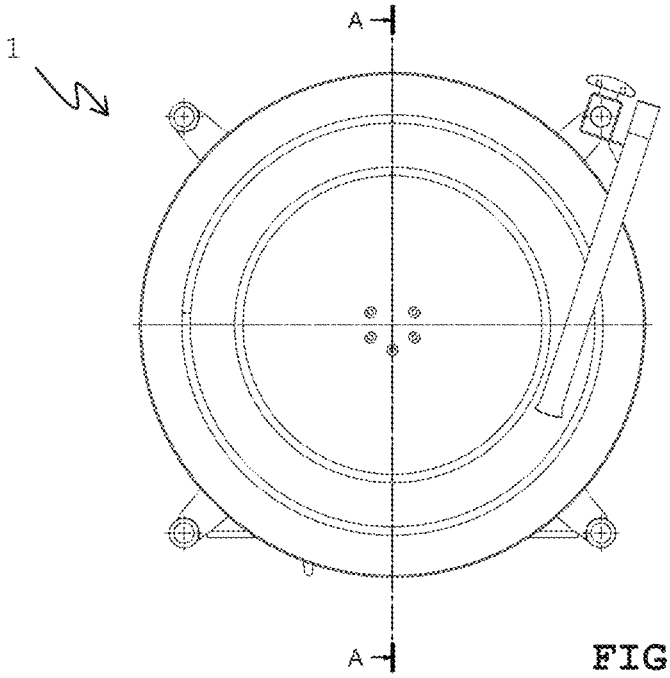
FIG. 3 is a top view of an exemplary hose reel.
Figure 4:
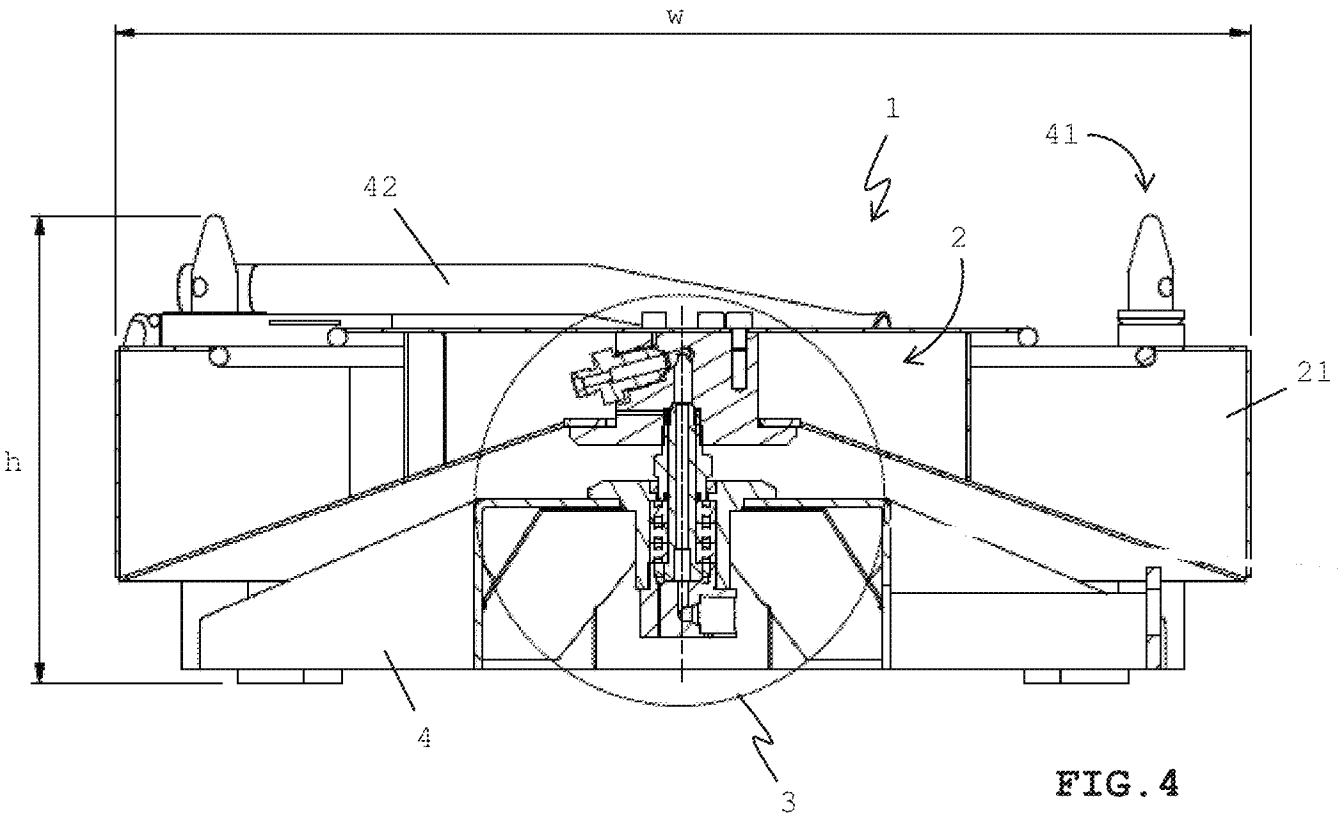
FIG. 4 is a cross sectional view of an exemplary hose reel.
Figure 8:
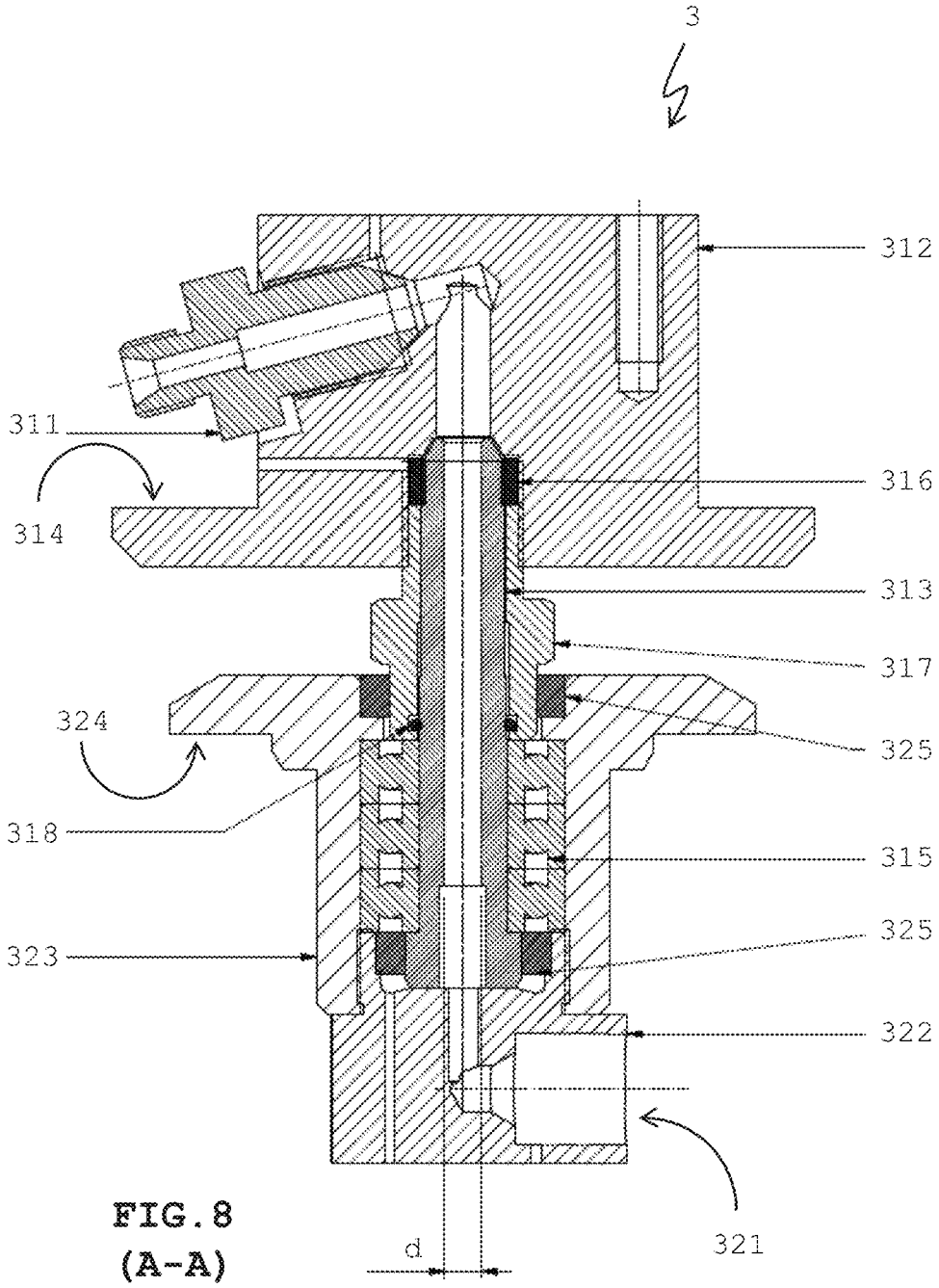
FIG. 8 is a cross sectional view of an exemplary swivel arrangement.

FIG. 3 shows a top view of a hose reel 1 such as shown in FIG. 1, wherein a line A-A is drawn indicative of where the cross sectional views of FIG. 4 and FIG. 8 are situated.

FIG. 4 shows a cross sectional view along the line A-A as shown in FIG. 3 of a hose reel 1 such as shown in FIG. 1. The circle indicates the location of the swivel arrangement 3 within the hose reel 1. The swivel arrangement 3 may be supported by the stationary stand 4 and at the same time support the rotatable hub 2. The swivel arrangement 3 may form the axis of the rotatable hub 2 around the central axis 30. Moreover, the swivel arrangement 3 may form a passage for fluid.

The hose reel 1, such as shown in FIG. 4, may have a diameter or width 'w' of around 600 mm and a height 'h' of around 247 mm.

FIG. 5 shows an exemplary swivel arrangement 3. The swivel arrangement 3 may include a rotatable part 31 and a stationary part 32. The rotatable part 31 may be connected to the rotatable hub 2, for example via a circumferential edge 314. Through holes 3140 may be provided in the circumferential edge 314 to connect the rotatable hub 2 using bolts. The stationary part 32 may be connected to the stationary stand 4, for example via a further circumferential edge 324. Through holes 3240 may be provided in the further circumferential edge 324 to connect the stationary stand 4 using bolts.

An inlet mount 321, which is typically a part of the stationary part 32 of the swivel arrangement 3, may provide connection means for connecting a supply hose to the hose reel 1. The supply hose may supply a fluid, such as pressurized gas (e.g. air) or a liquid (e.g. water) from a fluid source to the hose reel 1. The fluid passes through the swivel arrangement 3 and may exit through an outlet mount 311. The outlet mount 311 is typically a part of the rotatable part of the swivel arrangement 3 and may provide connection means for connecting the hose of the hose reel 1. It will be understood that the direction of the flow of the fluid through the swivel arrangement 3 is not limited to the direction from inlet mount 321 to outlet mount 311 and may be in the reverse direction.

The rotatable part 31 may include a head part 312. The outlet mount 311 may extend in a direction away from the central axis 30 through the head part 312. The outlet mount 311 may thus be located at a side of the head part 312. The head part 312 may have a top surface 3120 onto which the cover 22 may be attached.

Figure 6:
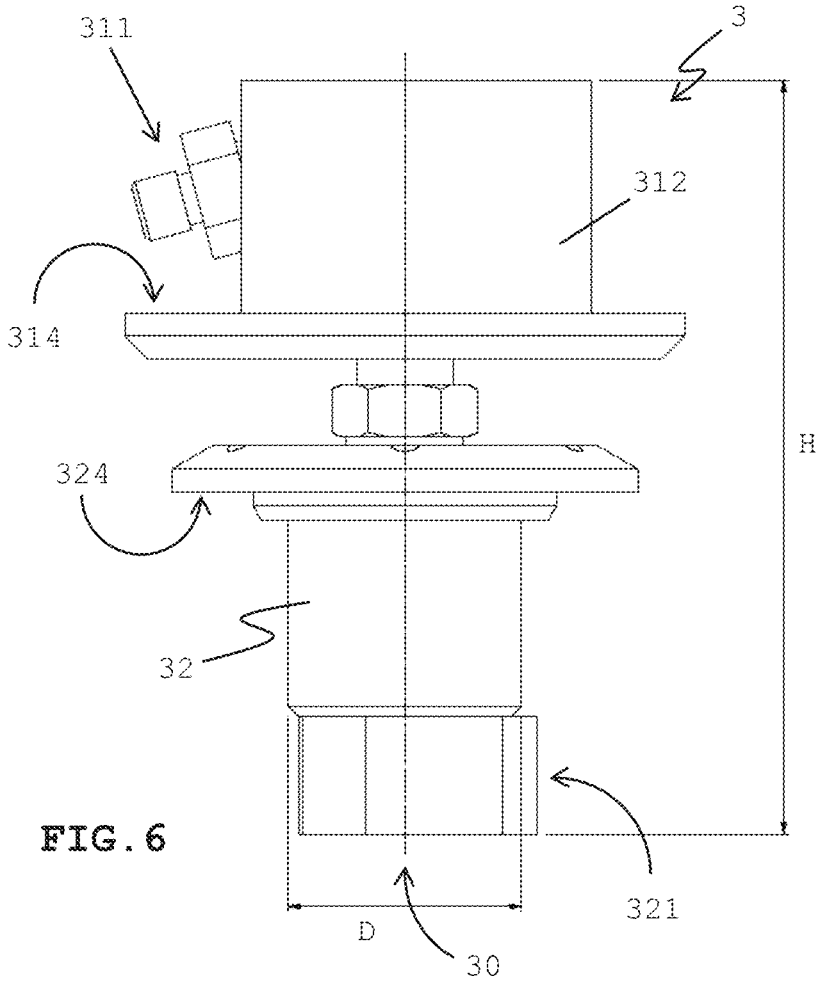
FIG. 6 is a side view of an exemplary swivel arrangement.

FIG. 6 shows as side view of a swivel arrangement 3 such as shown in FIG. 5. Of the rotatable parts, the outlet mount 311, the head part 312 and the circumferential edge 314 are shown. Of the stationary part 32, the inlet mount 321 and the further circumferential edge 324 are shown. Also the central axis 30 is indicated.

The swivel arrangement 3, such as shown in FIG. 6, may have a height 'H' of around 162 mm. The section of the stationary part 32 that fits inside the stationary stand 4 may have a diameter 'D' of around 50 mm.

Figure 7:
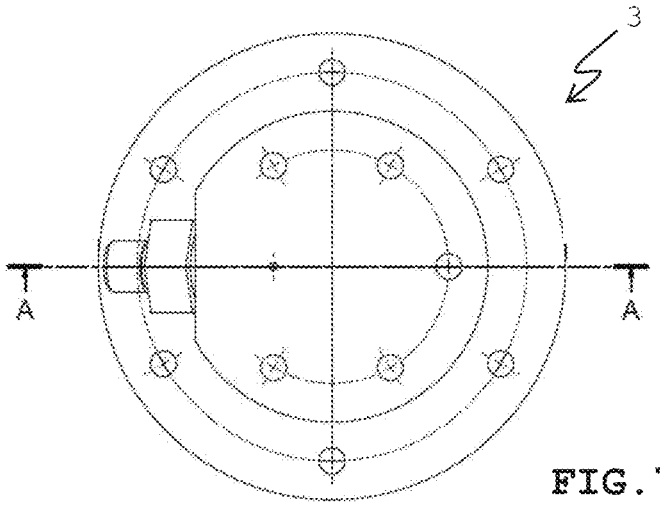
FIG. 7 is a top view of an exemplary swivel arrangement.

FIG. 7 shows a top view of a swivel arrangement 3 such as shown in FIG. 5, wherein the line A-A is drawn indicative of where the cross sectional views of FIG. 4 and FIG. 8 are situated.

FIG. 8 shows a cross-sectional view along the line A-A as shown in FIG. 7 of a swivel arrangement 3 such as shown in FIG. 5. The circumferential edge 314 is shown, onto which the hub 2 may be installed. When the hose reel 1 is used in a horizontal orientation such as shown in FIG. 1, the circumferential edge 314 may support the hub 2 from the top surface of the circumferential edge 314. The further circumferential edge 324 may allow the swivel arrangement 3 to be supported by the stationary stand 4 from the bottom surface of the further circumferential edge 324.

To allow fluid to pass between the inlet mount 321 and the outlet mount 311, a hollow shaft 313 may guide the fluid through the swivel arrangement, preferably along the central axis 30. The hollow shaft 313 may be part of the rotatable part 31 of the swivel arrangement 3. The connection between the rotatable hollow shaft 313 and the stationary input mount 321 may be realized using a swivel joint 322. The hollow shaft 313 may have a diameter 'd' of around 6.3 mm.

To enable the rotatable part of the swivel arrangement 3, and therewith the rotatable hub 2, to rotate smoothly within the hose reel 1, a bearing arrangement 315 may be rotatably arranged within a stationary bearing house 323. The bearing arrangement 315 may comprise a radial ball bearing that allows smooth rotation of the rotatable part along the central axis 30.

The swivel arrangement 3 of FIG. 8 may further include a pressure ring 316, a pressure nut 317, an O-ring 318 and/or seals 326.

Principally the hose reel 1 may be used for any kind of reelable hose with any kind of fluid under any conventional pressure. The swivel arrangement 3 may be an integrated swivel that both supports the inner hub and at the same time make a leak free high pressure rotating movement. The swivel arrangement may be used to pass fluid under a high pressure, for example around 20K Psi, thereby enabling the hose reel 1 to be used for the cleaning of the interior of heat exchangers, which may involve a TLE or TLC.

For the cleaning of the interior of a heat exchanger, the TLE or LTC machine may be brought into position in conjunction with the heat exchanger. The hose reel 1 (or multiple hose reels in case of more needed hoses) may be placed near the TLE or LTC machine. A high-density polyethylene (HDPE) hose may be connected between the TLE or LTC machine and the hose reel 1 and may function as a guidance hose for the high pressure hose on the hose reel 1. The high pressure hose may have been fed through this HDPE, hose and placed in the TLE or LTC machine. The high pressure hose from the pump may be connected to the inlet mount 321 of the swivel arrangement 3. The TLE or LTC machine may feed de hose directly to the 'to be cleaned' object and may roll off the reel. When the TLE or LTC machine withdraws the hose from the object the push-back and at the same time pushing movement due to the stiffness of the hose may cause rolling on of the reel.

Because the swivel arrangement 3 may be a smoothly rotating part, there may be little resistance and the therefore the reel may be brought easily in motion. So the roll on and roll off of the reel may be an easy task and may be generated from the movement of the TLE or LTC.

Parts of the hose reel may be made from aluminum and/or stainless steel.

The invention claimed is:

1. A hose reel comprising a rotatable hub and a stationary stand, wherein the rotatable hub is arranged to roll on or roll off a hose, characterized by a swivel arrangement that forms an axis that extends along a central axis of the rotatable hub, wherein the swivel arrangement comprises a rotatable part that is rotatable around the central axis, the rotatable part connecting to the rotatable hub, wherein the swivel arrangement further comprises a stationary part connecting to the stationary stand, wherein the swivel arrangement forms a passage for a fluid, wherein the stationary stand allows multiple hose reels to be stacked, wherein the swivel arrangement allows the stationary stands of stacked hose reels to be non-movably fixed while the rotatable hubs of the stacked hose reels are independently rotatable, and wherein the stationary stand comprises connection pins extending in a direction parallel to the direction of the central axis, each pin comprising a top end and a bottom end, wherein the top end of a pin of one hose reel is arranged to interconnect with the bottom end of a pin of another hose reel.

2. The hose reel according to claim 1, wherein the stationary stand is arranged to support the rotatable hub via the swivel arrangement.

3. The hose reel according to claim 1, wherein the rotatable part of the swivel arrangement comprises an outlet mount for connecting the hose to the rotatable hub, and wherein the outlet mount is arranged to rotate with the rotatable hub when rolling on or rolling off the hose.

4. The hose reel according to claim 3, wherein the rotatable part of the swivel arrangement comprises a head part, wherein the outlet mount passes through the head part in a direction away from the central axis.

5. The hose reel according to claim 4, wherein a top of the head part forms a surface substantially perpendicular to the central axis for supporting a cover that covers at least a portion of the hose when rolled onto the rotatable hub.

6. The hose reel according to claim 3, wherein the stationary part of the swivel arrangement comprises an inlet mount for connecting an external hose to the hose reel, and wherein the outlet mount is rotatably connected to the inlet mount by a swivel joint.

7. The hose reel according to claim 6, wherein the rotatable part of the swivel arrangement comprises a hollow shaft aligned with the central axis, wherein the hollow shaft is connected to the outlet mount and arranged to rotate around the central axis with the rotatable hub when rolling on or rolling off the hose, wherein the hollow shaft is movably connected to the inlet mount via the swivel joint, and wherein the hollow shaft is rotatably mounted within the stationary part of the swivel arrangement by a bearing arrangement.

8. The hose reel according to claim 1, wherein the stationary part of the swivel arrangement comprises an inlet mount for connecting an external hose to the hose reel.

9. The hose reel according to claim 1, wherein the rotatable part of the swivel arrangement comprises a first circumferential edge extending perpendicularly from and centered around the central axis, the first circumferential edge comprising one or more through holes for fixing the rotatable hub to the rotatable part of the swivel arrangement.

10. The hose reel according to claim 1, wherein the stationary part of the swivel arrangement comprises a second circumferential edge extending perpendicularly from and centered around the central axis, the second circumferential edge comprising one or more through holes for fixing the stationary stand to the stationary part of the swivel arrangement.

11. The hose reel according to claim 1, further comprising a hose guide for guiding the hose from the rotatable hub to outside of a perimeter of the stationary stand.

12. The hose reel according to claim 1, further comprising a hose guide for guiding the hose from the rotatable hub to outside of a perimeter of the stationary stand, and wherein the hose guide is adjustably connected to one of the pins.

13. The hose real according to claim 1, wherein the swivel arrangement is arranged to pass the fluid under a high pressure around 20K Psi.

* * * * *